US009131746B2

(12) United States Patent
Arciuolo

(10) Patent No.: US 9,131,746 B2
(45) Date of Patent: Sep. 15, 2015

(54) FOOT ORTHOTIC

(75) Inventor: Matthew J. Arciuolo, Milford, CT (US)

(73) Assignee: Roar Licensing, LLC, Milford, CT (US)

( * ) Notice: Subject to any disclaimer, the term of this patent is extended or adjusted under 35 U.S.C. 154(b) by 240 days.

(21) Appl. No.: 13/596,559

(22) Filed: Aug. 28, 2012

(65) Prior Publication Data

US 2014/0059895 A1 Mar. 6, 2014

(51) Int. Cl.

| | |
|---|---|
| ***A43B 17/00*** | (2006.01) |
| ***A43B 7/00*** | (2006.01) |
| ***A43B 13/02*** | (2006.01) |
| ***A43B 7/14*** | (2006.01) |
| ***A43B 13/14*** | (2006.01) |

(52) U.S. Cl.

CPC . *A43B 7/00* (2013.01); *A43B 7/141* (2013.01); *A43B 7/142* (2013.01); *A43B 7/143* (2013.01); *A43B 7/144* (2013.01); *A43B 7/145* (2013.01); *A43B 7/1425* (2013.01); *A43B 7/1435* (2013.01); *A43B 13/026* (2013.01); *A43B 13/141* (2013.01); *A43B 17/003* (2013.01)

(58) Field of Classification Search

CPC ..... A43B 1/00; A43B 5/06; A43B 13/00; A43B 13/02; A43B 13/023; A43B 13/026; A43B 13/04; A43B 13/18; A43B 13/38; A43B 17/00; A43B 17/003; A43B 17/006

USPC ..... 36/43, 44, 129, 114, 102, 107

See application file for complete search history.

(56) References Cited

U.S. PATENT DOCUMENTS

| | | | | | |
|---|---|---|---|---|---|
| 898,084 | A | * | 9/1908 | Backermann | 36/7.8 |
| 3,161,970 | A | * | 12/1964 | Purtell | 36/43 |
| 4,155,180 | A | * | 5/1979 | Phillips | 36/129 |
| 4,858,338 | A | * | 8/1989 | Schmid | 36/44 |
| 4,899,465 | A | * | 2/1990 | Bleimhofer et al. | 36/14 |
| 5,052,130 | A | * | 10/1991 | Barry et al. | 36/107 |
| 5,123,180 | A | * | 6/1992 | Nannig et al. | 36/43 |
| 5,179,791 | A | * | 1/1993 | Lain | 36/27 |
| 5,191,727 | A | | 3/1993 | Barry | |
| 5,367,790 | A | * | 11/1994 | Gamow et al. | 36/27 |
| 5,528,842 | A | | 6/1996 | Ricci | |
| 5,647,147 | A | | 7/1997 | Coomer | |
| 5,689,903 | A | * | 11/1997 | Aumann | 36/77 R |
| 5,778,562 | A | * | 7/1998 | Karl-Heinz | 36/44 |
| 6,029,374 | A | | 2/2000 | Herr | |

(Continued)

FOREIGN PATENT DOCUMENTS

| | | | |
|---|---|---|---|
| DE | 4414064 | A1 | 11/1994 |
| WO | WO 2007/046133 | A1 | 1/2003 |

OTHER PUBLICATIONS

Clark et al., Reinforced Lower-Limb Orthosis-Design Principles, Orthotics and Prosthetics, vol. 32, No. 2, pp. 35-45, Jun. 1978.

(Continued)

*Primary Examiner* — Marie Bays

(74) *Attorney, Agent, or Firm* — McCarter & English, LLP

(57) ABSTRACT

A foot orthotic comprising: a toe platform, the toe platform comprising a toe, sulcus, and ball; a longitudinal arch pad in communication with the toe platform; a heel cup in communication with the longitudinal arch pad, the heel cup comprising a heel; where the orthotic is made from a flexible material, and where in order to form an angle β that is greater than 0° between the toe platform and the remainder of the orthotic, a pre-load pressure P is required.

16 Claims, 4 Drawing Sheets

(56) References Cited

U.S. PATENT DOCUMENTS

| | | | | |
|---|---|---|---|---|
| 6,247,249 | B1 | 6/2001 | Lindqvist | |
| 6,449,878 | B1 | 9/2002 | Lyden | |
| 6,470,599 | B1 * | 10/2002 | Chu | 36/113 |
| 6,502,330 | B1 * | 1/2003 | David et al. | 36/88 |
| 6,560,902 | B1 * | 5/2003 | Eschweiler | 36/44 |
| 6,745,501 | B2 | 6/2004 | Brown | |
| 6,915,598 | B2 | 7/2005 | Grisoni | |
| 7,062,865 | B1 * | 6/2006 | Nordt, III | 36/27 |
| 7,266,910 | B2 * | 9/2007 | Ingimundarson | 36/44 |
| 7,401,422 | B1 * | 7/2008 | Scholz et al. | 36/44 |
| 7,487,604 | B2 * | 2/2009 | Perron, Jr. | 36/107 |
| 7,513,880 | B2 | 4/2009 | Ingimmundarson et al. | |
| 7,900,376 | B2 * | 3/2011 | Rabushka | 36/27 |
| 8,028,442 | B2 | 10/2011 | Hodgson | |
| 8,191,285 | B2 * | 6/2012 | Perron, Jr. | 36/107 |
| 8,631,592 | B2 | 1/2014 | Adair et al. | |
| 8,695,235 | B2 * | 4/2014 | Perron, Jr. | 36/107 |
| 2002/0166184 | A1 | 11/2002 | Lindqvist | |
| 2003/0061735 | A1 * | 4/2003 | Polifroni | 36/44 |
| 2004/0102727 | A1 | 5/2004 | Smits | |
| 2004/0154192 | A1 | 8/2004 | Bengtsson et al. | |
| 2005/0081401 | A1 * | 4/2005 | Singleton et al. | 36/34 R |
| 2009/0217551 | A1 * | 9/2009 | Shirokikh | 36/102 |
| 2009/0307925 | A1 * | 12/2009 | Pfister | 36/28 |
| 2010/0083534 | A1 * | 4/2010 | Howlett | 36/44 |
| 2010/0218399 | A1 * | 9/2010 | Jeong | 36/44 |
| 2014/0000125 | A1 | 1/2014 | Butler | |

OTHER PUBLICATIONS

Zukas, et al., The Influence of Nanofillers on the Mechanical Properties of Carbon Fibre Reinforced Methyl Methacrylate Composite, Materials Science (Medziagotyra), vol. 18, No. 3, pp. 250-255, 2012.

Lipfert, et al., Impulsive Ankle Push-Off Powers Leg Swing in Human Walking, The Jountal of Experimental Biology, 21 pages, 2013.

* cited by examiner

FOOT ORTHOTIC

TECHNICAL FIELD

The present invention generally relates to foot orthotics, and more specifically to foot orthotics designed to increase propulsion.

BACKGROUND

Foot Orthoses normally comprise a specially fitted insert or footbed to a shoe. Also commonly referred to as "orthotics", these orthotics may provide support for the foot by distributing pressure or realigning foot joints while standing, walking or running. As such they are often used by athletes to relieve symptoms of a variety of soft tissue inflammatory conditions like plantar fasciitis. Also, orthotics have been designed to address arch support or cushioning requirements.

However, there are no known orthotics designed to increase propulsion, either for athletes or people in their everyday lives. Thus there is a need for an invention that solves the above listed and other disadvantages.

SUMMARY

The disclosed invention relates to a foot orthotic comprising: a toe platform, the toe platform comprising a toe, sulcus, and ball; a longitudinal arch pad in communication with the toe platform; a heel cup in communication with the longitudinal arch pad, the heel cup comprising a heel; where the orthotic is made from a flexible material, and where in order to form an angle β that is greater than 0° between the toe platform and the remainder of the orthotic, a pre-load pressure P is required.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
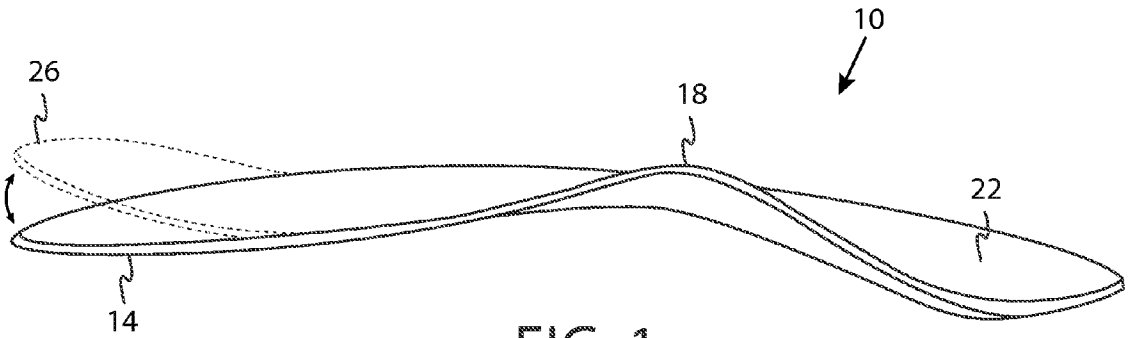
FIG. 1 is a side view of one embodiment of the disclosed orthotic.

The disclosed orthotic is designed to increase propulsivity in walking, running and jumping activities. The orthotic is designed with about a 15° plantar flexion from the ball of the foot to the toe and about a 5° plantar flexion from the 5th metatarsal to the hallux so that as the user progresses through the phases of gait, the orthotic progressively loads potential energy at foot flat and heel-off and releases that energy at toe off. This is accomplished by a number of design features. The orthotic may use pre-preg carbon fibers. Pre-preg is a term for "pre-impregnated" composite fibers where a material, such as epoxy is already present. These pre-preg carbon fibers may take the form of a weave or may be uni-directional. They already contain an amount of the matrix material used to bond them together and to other components during manufacture. The pre-preg are mostly stored in cooled areas since activation is most commonly done by heat. Hence, composite structures built of pre-pregs will mostly require an oven or autoclave to cure. Owing to the use of "pre-preg" carbon fiber in the disclosed orthotics, the orthotics can be designed with varying amounts of resistance or spring at specific parts of the orthotic. Depending on how the pre-preg carbon fiber layers are arranged, the orthotic can be stiff where the user needs it to be and flexible where it has to be. This pre-preg layering is a new process that is superior to standard carbon fiber in that it can be tailored to accomplish an increase in propulsion by increasing the natural spring effect of the human arch and foot structure in an orthotic. The carbon fiber layers may be thickest under the ball of the foot and to the heel where the weight is the greatest and gradually get thinner distally under the users toes. This unique layering process tailors the spring effect of the orthotic so that it is stiff where it is needed and flexible where it is necessary to maximize its effect on the human foot. Orthotics are customarily shaped to mirror the shape and motion of the foot. The disclosed orthotic may be shaped in the opposite direction using the body's own weight to load the spring, and the user's own motion to increase this spring potential in the orthotic and then owing to the stiffness and lightweight of carbon fiber, the spring is unloaded at a rapid rate, propelling the user forward.

The disclosed orthotic can provide more "spring" or "push" to a sprinter that wants quicker, more explosive starts, a marathoner that is looking for more efficiency and stamina over longer distances, or a basketball player that wants higher standing jumps. In the sporting arena, a $100^{th}$ of a second can mean the difference between first and fourth place (i.e. track and field), and thus an athlete using the disclosed orthotic may have that advantage.

The disclosed orthotic design loads the foot plate while just standing and this spring effect is amplified when the toes are dorsiflexed (turned up). No other known orthotics on the market today does this. As the foot leaves the ground, preparing for its next heel strike, the orthotic unloads into plantarflexion at a rapid rate using ground reactive force to propel the user forward by amplifying push-off.

Prior art orthotics are curved and shaped to take the shape of the human foot conforming to every curve, not designed, as the disclosed orthotic is, to maximize the providing of thrust either forward, upward, and/or laterally.

The disclosed orthotic may be made from pre-preg carbon fiber. The carbon fiber fabric may be shipped as a dry loosely woven cloth. A variety of methods are used to apply wet epoxy resin to the cloth and then let it set at room temperature to cure. Pre-preg refers to carbon fiber fabric that is pre-impregnated with epoxy resin from the manufacturer. It may be a thick material that is applied in layers to the mold. Once it is applied, a special clear plastic sheet is mounted over the pre-preg and affixed to the edges of the mold with foam tape. This process creates an air tight seal between the inside of the mold and the outside. A vacuum pump is then applied and the air is removed. As the air is removed the plastic presses against the pre-preg and against the inside of the mold. Next, the pre-preg is allowed to cure. Heat is then applied to the fiber/mold and the fiber is separated from the mold.

FIG. 1 is a side view of one embodiment of the disclosed orthotic 10. This figure shows a right foot orthotic. One of ordinary skill will recognize that the disclosed invention also includes left foot orthotics. The orthotic 10 may have a toe platform 14, a longitudinal arch pad 18 and a heel cup 22. One embodiment of how the orthotic 10 can preload the spring function of the orthotic is shown in dashed line 26. The dashed line 26 shows how the toe platform 14 can flex with respect to the rest of the orthotic, providing a preload in the orthotic 10. When this preload is released, the orthotic may provide thrust or propulsion to the user, which may help the user run faster, jump farther, jump higher, and/or push harder.

Figure 2:
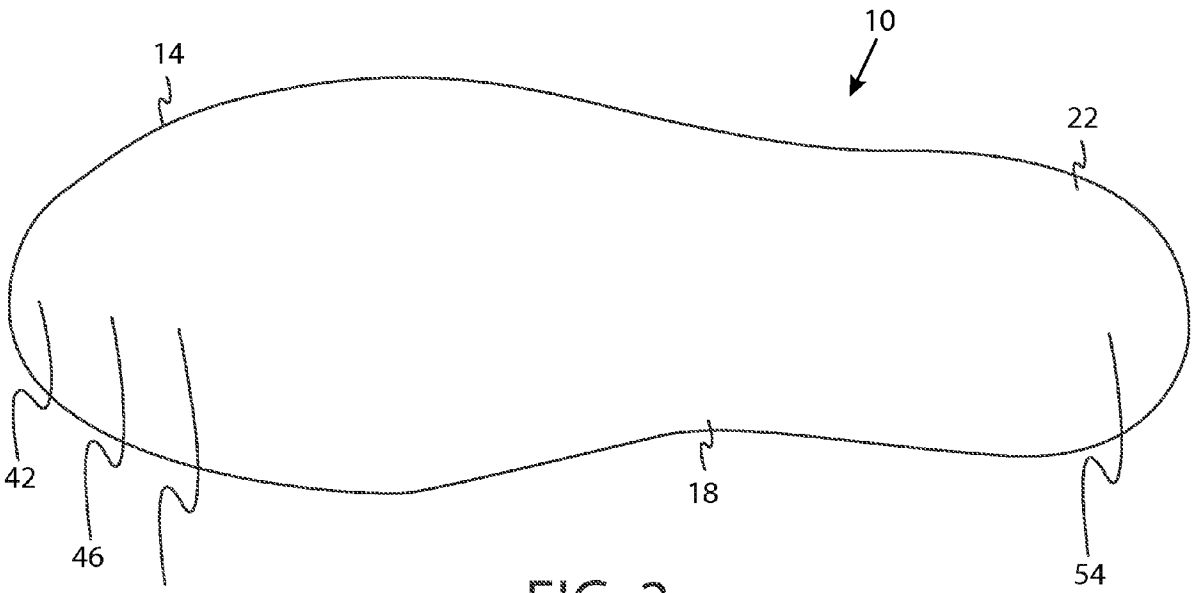
FIG. 2 is a top view of the orthotic from FIG. 1.

FIG. 2 is a top view of the orthotic 10 from FIG. 1. FIG. 2 shows where thickness measurements were made below. Thicknesses were measured generally at the toe 42, sulcus 46, ball 50, and heel 54.

Figure 3:
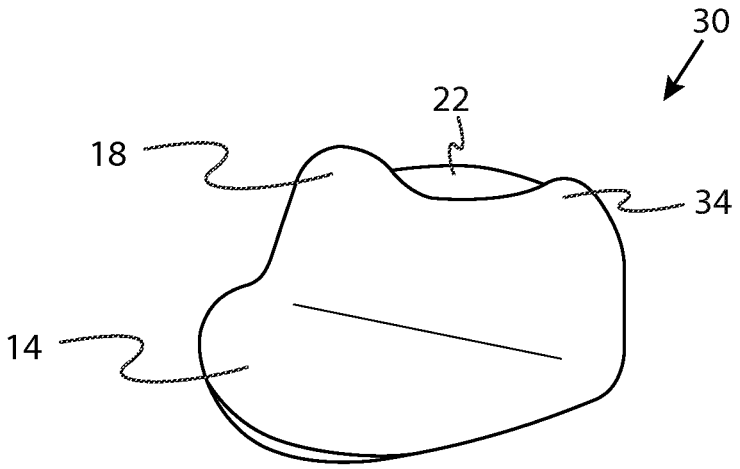
FIG. 3 is a front perspective view of another embodiment of the disclosed orthotic.

FIG. 3 is a generally front perspective view of another embodiment of the disclosed orthotic 30. The shown orthotic 30 is for a left foot. This embodiment of the orthotic 30 may have a toe platform 14, a longitudinal arch pad 18, a heel cup 22, and a peroneal arch pad 34.

Figure 4:
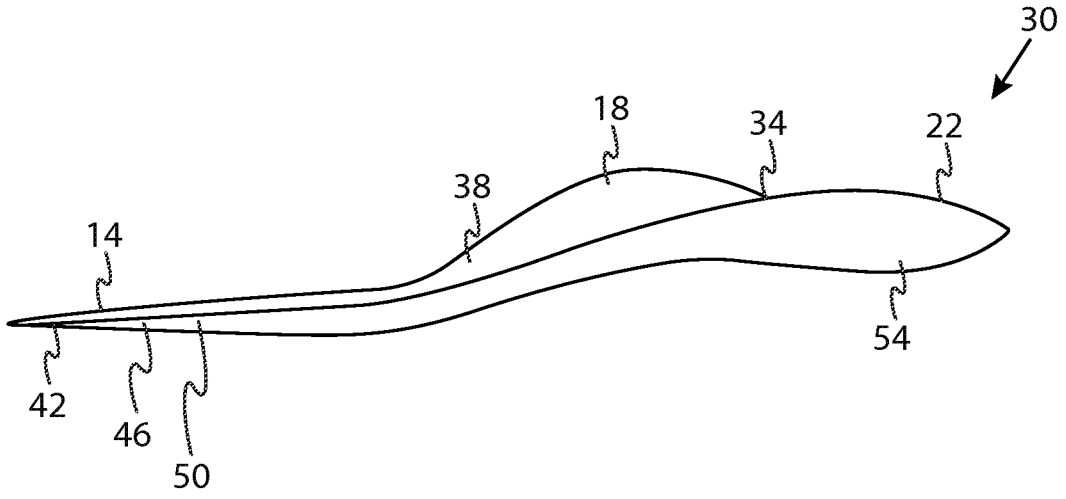
FIG. 4 is a side view of the orthotic from FIG. 3.

FIG. 4 is a side view of the orthotic 30 from FIG. 3. The thickness of the material that makes up the orthotic 30 may vary. For instance, for a female small sized orthotic the thickness may be about 1 mm at the toe 42, about 1.25 mm at the sulcus 46, and about 1.5 mm at the ball 50 to the heel 54. The small sized female orthotic may correspond to ladies' shoe sizes 5-6. For a female medium sized orthotic the thickness may be about 1.25 mm at the toe 42, about 1.5 mm at the sulcus 46, and about 1.75 mm at the ball 50 to the heel 54. The medium sized female orthotic may correspond to ladies' shoe sizes 7-8. For a female large sized orthotic the thickness may be about 1.5 mm at the toe 42, about 1.75 mm at the sulcus 46, and about 2 mm at the ball 50 to the heel 54. The large sized female orthotic may correspond to ladies' shoe sizes 9-10. For a female extra-large sized orthotic the thickness may be about 1.75 mm at the toe 42, about 1.75 mm at the sulcus 46, and about 2.25 mm at the ball 50 to the heel 54. The extra-large sized female orthotic may correspond to ladies' shoe sizes 11-12.

For a male small sized orthotic the thickness may be about 1 mm at the toe 42, about 1.25 mm at the sulcus 46, and about 1.5 mm at the ball 50 to the heel 54. The small sized male orthotic may correspond to men's shoe sizes 6-7. For a male medium sized orthotic the thickness may be about 1.25 mm at the toe 42, about 1.5 mm at the sulcus 46, and about 1.75 mm at the ball 50 to the heel 54. The medium sized male orthotic may correspond to men's shoe sizes 8-9. For a male large sized orthotic the thickness may be about 1.5 mm at the toe 42, about 1.75 mm at the sulcus 46, and about 2 mm at the ball 50 to the heel 54. The large sized male orthotic may correspond to men's shoe sizes 10-11. For a male extra-large sized orthotic the thickness may be about 1.75 mm at the toe 42, about 1.75 mm at the sulcus 46, and about 2.25 mm at the ball 50 to the heel 54. The extra-large sized male orthotic may correspond to men's shoe sizes 12-13. Of course, one of ordinary skill in the art will recognize that smaller and larger thicknesses may be used to depending on the amount of "spring effect" one desires from the orthotic.

Figure 5:
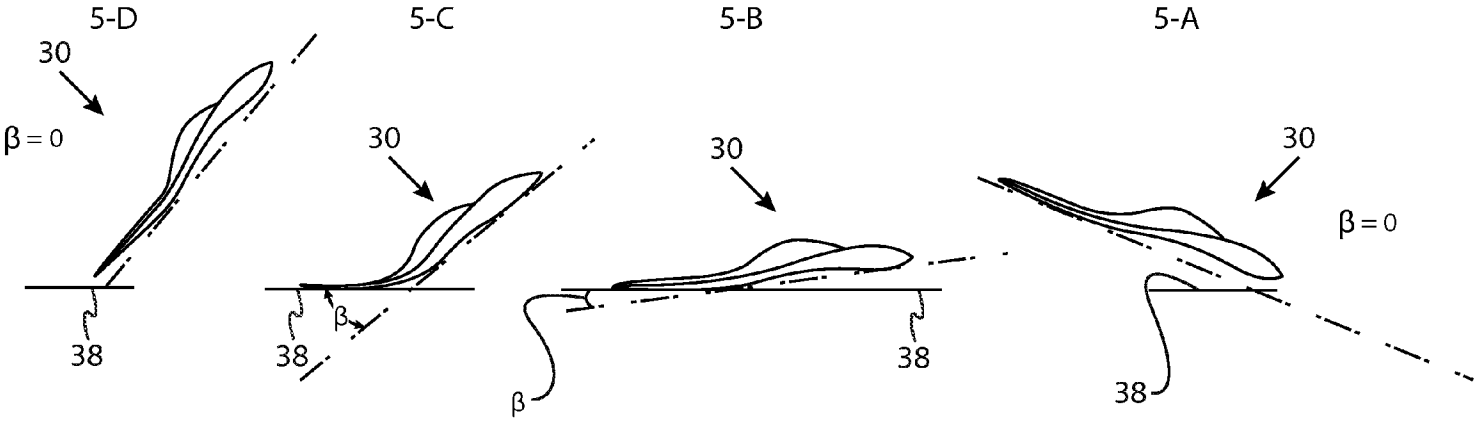
FIG. 5 is a view of the right orthotic during the different phases of a step or stride.

FIG. 5 shows the orthotic 30 of a right foot during the different phases of a step or stride. 5-A shows the orthotic 30 as the foot is about to strike the ground 38 heel first. At 5-A, the flex angle β is generally 0°, that is the angle made between the toe platform and rest of the orthotic due to a force applied by a user to the orthotic, generally during walking, running, and/or jumping. 5-B shows the orthotic as the foot begins to leave the ground and a pre-load has already started to occur in the toe platform 14, such that angle β is about 20°. 5-C shows an even greater pre-load in the toe platform 14, such as there is an angle β of about 45°. 5-D shows the foot off of the ground 38, and the orthotic 30 has expended its pre-load by providing thrust or propulsion to the user's foot and/or leg. The angle β is now back to 0°.

Figure 6:
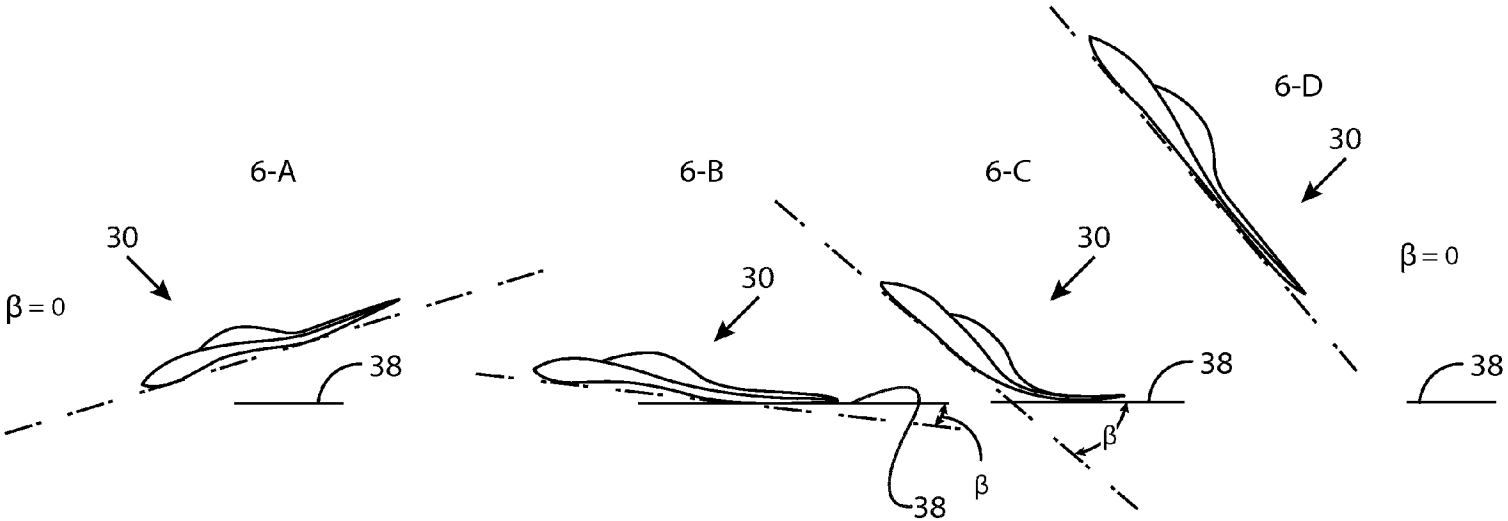
FIG. 6 is a view of the left orthotic during the different phases of a step or stride.

FIG. 6 shows the orthotic 30 of a left foot during the different phases of a step or stride. 6-A shows the orthotic 30 as the foot is about to strike the ground 38 heel first. At 6-A, the flex angle β between the toe platform 14 and the rest of the orthotic 30 is generally 0° (or no angle). 6-B shows the orthotic as the foot begins to leave the ground and a pre-load has already started to occur in the toe platform 14, such that β is about 20°. 6-C shows an even greater pre-load in the toe platform 14, such as there is an angle β of about 45°. 6-D shows the foot off of the ground 38, and the orthotic 30 has expended its pre-load by providing thrust or propulsion to the user's foot and/or leg. The angle β is now back to 0°.

In order to form a non-zero angle β, a pre-load force of F is required to create the pre-load (and the flex angle β). The force of course is spread over an area of the orthotic, and in the table below will be described generally as a pressure (psi). The pressure required to create the flex angle β may range from about 1 psi to about 100 psi. For one embodiment, the pressures P for various flex angles β are shown below:

| Flex Angle β | Pressure P |
|---|---|
| 10° | 6.7 psi |
| 20° | 9.4 psi |
| 30° | 12.8 psi |
| 40° | 16.8 psi |
| 50° | 23.8 psi |
| 60° | 28.3 psi |
| 70° | 32.8 psi |
| 80° | 37.2 psi |
| 90° | 39.5 psi |

One of ordinary skill in the art will recognize that the pressure associated with the flex angle β may be changed from the table above depending on the amount of "spring effect" one desires from the orthotic.

The orthotic 10, 30 works in that it decreases the rate of dorsiflexion of the toes (loading a spring) and increases the rate of plantarflexion of the toes (releasing the spring) in the 4th phase of gait (e.g. FIGS. 5-D and 6-D). This maximizes the first ray leverage against ground reactive forces thereby imparting maximum force to improve propulsion linearly (forward) and vertically (up) and laterally (side to side).

Figure 7:
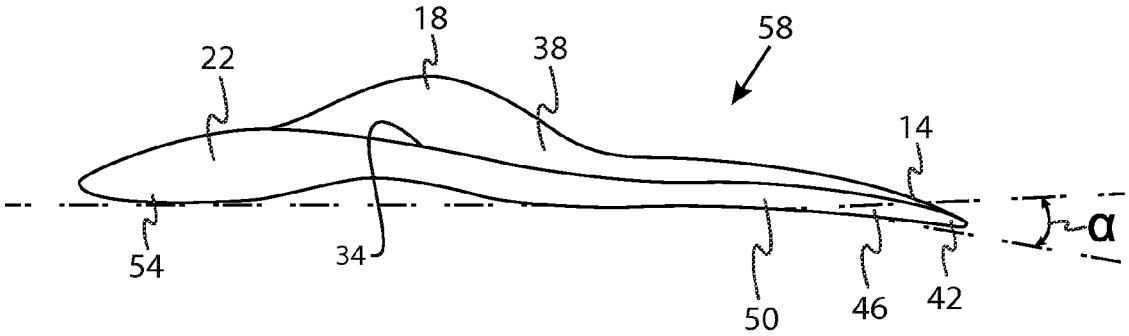
FIG. 7 is a side view of another embodiment of a right orthotic.

FIG. 7 shows another embodiment of an orthotic 58. In this embodiment there is an additional preload in the orthotic 58. That is there is a dip in the toe 42 with respect to the toe platform 14, such that the toe 42 makes an angle γ with the toe platform. The dip in the big toe area just gives it a little more spring. The normal human gait starts at heel strike which is at the back/outside portion of the heel. As gait progresses the foot rolls through the arch area and the center of gait starts to move medially and finally the last thing that leaves the ground is the big toe. Therefore if the big toe is the last thing that leaves the ground then the big toe area of the orthotic must be the last thing that leaves the ground. To accomplish this, the big toe area of the orthotic dips and provides the last thing on the ground with more spring. Having an angle γ gives the orthotic 58 an increased spring loading rate. The angle γ may range from about 1° to about 25°, and is preferably about 15°.

When the orthotic 58 is placed on a flat surface the heel and the toe are the only parts that touch the surface. Therefore, when one applies weight to the orthotic 58 then the entire orthotic 58 is generally flattens, thus preloading the spring effect of the orthotic 58. This additional preloading seems to make a big difference. When one flexes his or her foot to walk or run the spring load is increased, giving the user an extra push.

The disclosed orthotic has many advantages. The orthotic may be specifically designed for different sports, e.g. an orthotic for a basketball player that develops increased vertical propulsion, an orthotic for a sprinter with increased linear propulsion, or an orthotic for a tennis player with increased lateral propulsion. The disclosed orthotic may provide a more "spring" or "push" to a sprinter that wants quicker, more explosive starts. The orthotic may give a marathoner more efficiency and stamina over longer distances. The orthotic may assist a basketball player to obtain higher standing jumps. The orthotic may replace the insole that comes with off the shelf footwear and give an increase in propulsion no matter what activity an individual participated in. The orthotic loads the foot plate while just standing and this spring effect is amplified when the toes are dorsiflexed (turned up). As the foot leaves the ground, preparing for its next heel strike, the orthotic unloads into plantarflexion at a rapid rate using ground reactive force to propel the user forward by amplifying push-off.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A foot orthotic, comprising:

a flexible element consisting of a sheet of material of substantially uniform thickness, the sheet of material defining a toe region, a heel region and a longitudinal arch pad region that extends from the toe region to the heel region, the sheet of material being structurally formed such that (i) only the toe region and the heel region contact a ground surface plane, and (ii) the longitudinal arch pad is spaced above the ground surface plane;

wherein the flexible element is fabricated from a flexible material that includes pre-impregnated carbon fibers; and wherein the pre-impregnated fibers are unidirectionally aligned.

2. The foot orthotic of claim 1, wherein the substantially uniform thickness of the sheet of material includes thicknesses that vary by about 0.5 mm.

3. The foot orthotic of claim 1, wherein the sheet of material further defines a ball region spaced from the toe region and wherein the sheet of material is structurally formed such that the ball region is spaced above the ground surface plane.

4. The foot orthotic of claim 1, wherein the flexible element defines a big toe region in a medial plantar portion of the toe region, and wherein the big toe region defines a non-zero angle dip relative to a lateral plantar portion of the toe region.

5. The foot orthotic of claim 4, wherein the non-zero angle is about 1° to about 25°.

6. The foot orthotic of claim 1, wherein the thickness of the flexible element in the toe platform region is about 1 mm to about 1.75 mm, wherein the thickness of the flexible element in the longitudinal arch pad region is about 1.25 mm to about 2 mm, and wherein the thickness of the flexible element in the heel region is about 1.5 mm to about 2.25 mm.

7. A foot orthotic, comprising:

a flexible element consisting of a sheet of material of substantially uniform thickness, the sheet of material defining a toe region, a heel region and a longitudinal arch pad region that extends from the toe region to the heel region, the sheet of material being structurally formed such that (i) only the toe region and the heel region contact a ground surface plane, and (ii) the longitudinal arch pad is spaced above the ground surface plane;

wherein the flexible element is fabricated from a flexible material that includes pre-impregnated carbon fibers; and wherein the pre-impregnated carbon fibers are incorporated into a woven cloth.

8. The foot orthotic of claim 7, wherein the thickness of the flexible element in the toe platform region is about 1 mm to about 1.75 mm, wherein the thickness of the flexible element in the longitudinal arch pad region is about 1.25 mm to about 2 mm, and wherein the thickness of the flexible element in the heel region is about 1.5 mm to about 2.25 mm.

9. The foot orthotic of claim 7, wherein the flexible element defines a big toe region in a medial plantar portion of the toe region, and wherein the big toe region defines a non-zero angle dip relative to a lateral plantar portion of the toe region.

10. The foot orthotic of claim 9, wherein the non-zero angle is about 1° to about 25°.

11. A foot orthotic, comprising:

a flexible element consisting of a sheet of material of substantially uniform thickness, the sheet of material defining a toe region, a heel region and a longitudinal arch pad region that extends from the toe region to the heel region, the sheet of material being structurally formed such that (i) only the toe region and the heel region contact a ground surface plane, and (ii) the longitudinal arch pad is spaced above the ground surface plane;

wherein the flexible element defines a big toe region in a medial plantar portion of the toe region, and wherein the big toe region defines a non-zero angle dip relative to a lateral plantar portion of the toe region.

12. The foot orthotic of claim 11, wherein the thickness of the flexible element in the toe platform region is about 1 mm to about 1.75 mm, wherein the thickness of the flexible element in the longitudinal arch pad region is about 1.25 mm to about 2 mm, and wherein the thickness of the flexible element in the heel region is about 1.5 mm to about 2.25 mm.

13. The foot orthotic of claim 11, wherein the flexible element is fabricated from a flexible material that includes pre-impregnated carbon fibers.

14. The foot orthotic of claim 11, wherein the flexible element is fabricated from a flexible material that includes several layers of cured pre-impregnated carbon fiber fabric.

15. The foot orthotic of claim 13, wherein the pre-impregnated carbon fibers are incorporated into a woven cloth.

16. The foot orthotic of claim 13, wherein the flexible element includes pre-impregnated fibers that are unidirectionally aligned.

* * * * *